US012089797B2

(12) United States Patent
Matsuda et al.

(10) Patent No.: US 12,089,797 B2
(45) Date of Patent: Sep. 17, 2024

(54) CLOTHES CARE DEVICE AND CLOTHES CARE APPARATUS

(71) Applicant: Samsung Electronics Co., Ltd., Suwon-si (KR)

(72) Inventors: Eiji Matsuda, Yokohama (JP); Hiroki Takita, Yokohama (JP); Koichi Hosomi, Yokohama (JP); Shigeki Hayashi, Yokohama (JP); Yasuo Ikeda, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 394 days.

(21) Appl. No.: 17/476,871

(22) Filed: Sep. 16, 2021

(65) Prior Publication Data

US 2022/0125253 A1 Apr. 28, 2022

(30) Foreign Application Priority Data

Oct. 27, 2020 (JP) ..... 2020-179781
Jan. 8, 2021 (JP) ..... 2021-002261
Apr. 30, 2021 (KR) ..... 10-2021-0056487

(51) Int. Cl.

| | |
|---|---|
| ***A47L 5/24*** | (2006.01) |
| ***A47L 7/00*** | (2006.01) |
| ***A47L 9/02*** | (2006.01) |
| ***D06F 58/10*** | (2006.01) |
| ***D06F 58/20*** | (2006.01) |

(Continued)

(52) U.S. Cl.

CPC ..... *A47L 5/24* (2013.01); *A47L 7/0009* (2013.01); *A47L 9/02* (2013.01); *D06F 58/10* (2013.01); *D06F 58/203* (2013.01); *D06F 43/002* (2013.01); *D06F 87/00* (2013.01)

(58) Field of Classification Search

CPC ..... A47L 5/24; A47L 9/02; A47L 7/00–0023; D06F 43/002; D06F 87/00

See application file for complete search history.

(56) References Cited

U.S. PATENT DOCUMENTS

2004/0200007 A1 10/2004 Heim
2008/0149150 A1 6/2008 Hausen (Continued)

FOREIGN PATENT DOCUMENTS

CN 108589157 A 9/2018
JP 3002142 U 9/1994

(Continued)

OTHER PUBLICATIONS

International Search Report dated Dec. 27, 2021; International Appln. No. PCT/KR2021/012281.

*Primary Examiner* — Spencer E. Bell
(74) *Attorney, Agent, or Firm* — Jefferson IP Law, LLP

(57) ABSTRACT

A clothes care device is provided. The clothes care device includes a collection box, a suction pipe, a washing cover, and a spray nozzle disposed inside the suction pipe and provided in such a way that an end of the spray nozzle faces a washing port, and the washing cover mounted to the washing port and provided to be pressed against clothes. By operating a washing water supply in a state in which the washing cover is pressed against the clothes by an operation of a suction device, the spray nozzle sprays washing water and the suction device suctions and collects the washing water.

12 Claims, 15 Drawing Sheets

(51) Int. Cl.
*D06F 87/00* (2006.01)
*D06F 43/00* (2006.01)

(56) References Cited

U.S. PATENT DOCUMENTS

| | | | | |
|---|---|---|---|---|
| 2015/0292132 | A1 | 10/2015 | Lee et al. | |
| 2019/0075985 | A1* | 3/2019 | King | A47L 9/10 |
| 2020/0157729 | A1 | 5/2020 | Liao et al. | |

FOREIGN PATENT DOCUMENTS

| | | | |
|---|---|---|---|
| JP | 2001-145682 | A | 5/2001 |
| JP | 5848157 | B2 | 1/2016 |
| KR | 10-1121169 | B1 | 2/2012 |

* cited by examiner

FIG. 5B

| | AREA OF OPENING PORTION($mm^2$) | | |
|---|---|---|---|
| | ~4 | 4~240 | 240~ |
| CONTAMINATION REMOVAL | × | ○ | × |
| FOREIGN SUBSTANCE REMOVAL | × | × | ○ |

CLOTHES CARE DEVICE AND CLOTHES CARE APPARATUS

CROSS-REFERENCE TO RELATED APPLICATION(S)

This application is based on and claims priority under 35 U.S.C. § 119(a) of a Japanese patent application number 2020-179781, filed on Oct. 27, 2020, of a Japanese patent application number 2021-002261, filed on Jan. 8, 2021, in the Japanese Intellectual Property Office, and of a Korean patent application number 10-2021-0056487, filed on Apr. 30, 2021, in the Korean Intellectual Property Office, the disclosure of each of which is incorporated by reference herein in its entirety.

BACKGROUND

1. Field

The disclosure relates to a clothes care device and a clothes care apparatus configured to remove partial contamination of clothes, such as a dress shirt or a suit.

2. Description of Related Art

It is common to wash clothes, etc. with a fully automatic washing machine. For example, dirty clothes such as shirts, blouses, pants, skirts, etc., are collected and put into a drum together with detergent and the like. By operating the washing machine, processes such as washing, rinsing, spinning, and further drying are automatically performed, and contamination (e.g., dirt, stains, etc.) of the entire clothes may be washed and removed.

However, in the case of clothes made of a fabric containing wool or silk such as a suit, a jacket, and traditional Korean clothes (e.g., hanbok), washing with a washing machine may cause damage to the shape, damage to the fabric, wrinkles, and tears. This may occur in dresses made of thin fabric. In the case of such delicate clothes, it is common to ask a professional cleaning company to remove the contamination.

Related to the disclosed to technology, a contamination suction device configured to remove a contaminated portion of clothes is known in the related art. The related art contamination suction device includes a header body for contamination suction with a handle. The header body for contamination suction is provided with a flat surface in which a suction hole is formed. Further, in the flat surface, a spray nozzle spraying water above the flat surface is provided.

In the case of washing partial contamination of clothes with the related art contamination suction device, a user operates the spray nozzle to spray water on a dirty part of clothes, thereby wetting contamination. The user brings the flat surface to the dirty part of clothes and suctions the wet contamination through the suction hole. The contamination suction device is attached to a three-dimensional ironing machine. Accordingly, it is possible to remove partial contamination of clothes when ironing the clothes.

The above information is presented as background information only to assist with an understanding of the disclosure. No determination has been made, and no assertion is made, as to whether any of the above might be applicable as prior art with regard to the disclosure.

SUMMARY

A washing machine operates based on an assumption that the entire clothing is to be decontaminated, that is a washing machine is configured to wash the entire clothes. Therefore, because a washing action acts on the entire clothes, it is ineffective for partial contamination where the contaminated part is locally limited to the clothes. Further, there may be traces of contamination left on the clothes. An amount of water required for one time washing is also large, and the washing process takes time. Therefore, washing using a washing machine is wasteful and not suitable for decontamination of a part of clothes in terms of saving water or energy. The problem can be even worse if the clothes are delicate clothes.

In this regard, a professional company can respond to a variety of clothes, and can also properly remove partial contamination. However, the cost is high. It is quite disadvantageous from an economic point of view.

In this regard, a contamination suction device of the related art may remove partial contamination of clothes without waste. In comparison with the washing machine, the related art contamination suction device is compact and configured to be installed anywhere. The related art contamination suction device may be used for delicate clothes. However, there are difficulties in terms of operability and removal effect.

That is, in the related art contamination suction device, the contamination is removed by wetting the dirty part of the clothes, and by suctioning the contamination. Accordingly, although the contamination adhering to the surface of the clothes can be removed, it is difficult to remove a stain that is adsorbed to the inside of the clothes.

In addition, in the operation, it is required to wet the contamination after spraying water. Therefore, it is necessary to wait for a while without suction immediately after spraying. Therefore, the operation is inconvenient and the work takes time.

Aspects of the disclosure are to address at least the above-described problems and/or disadvantages and to provide at least the advantages described below. Accordingly, an aspect of the disclosure is to provide a clothes care device capable of effectively removing partial contamination of clothes in a short time and capable of being easy to handle.

Additional aspects will be set forth in part in the description which follows and, in part, will be apparent from the description, or may be learned by practice of the presented embodiments.

In accordance with an aspect of the disclosure, a clothes care device configured to remove partial contamination of clothes, etc. by operating a washing device is provided. The clothes care device includes a collection box in which an electric fan is provided, a suction pipe comprising a washing port and connected to the collection box to allow a suction force to be generated in the washing port by the electric fan, a washing cover removably mounted to the washing port, and a spray nozzle provided inside the suction pipe to be spaced apart from the washing cover, and provided to face the washing port.

In accordance with another aspect of the disclosure, the washing device includes a device body gripped and operated with one hand, a suction pipe provided on the device body and including a washing port provided on an end thereof, a spray nozzle provided inside the suction pipe and positioned to face the washing port, and a washing cover mounted to the washing port so as to be pressed against an object to be decontaminated.

In accordance with another aspect of the disclosure, the clothes care device further includes a washing water supply device configured to supply washing water to the spray nozzle, and a suction device configured to suction an inside of the suction pipe. In a state in which the washing cover is pressed against the object to be decontaminated by an operation of the suction device, when the washing water supply device is operated, the spray nozzle may spray washing water to the object be decontaminated and the suction device may suction and collect the washing water.

In accordance with another aspect of the disclosure, the clothes care device is easy to handle because the washing device is configured to be operated with one hand to remove partial contamination, such as clothes, which are objects to be decontaminated. In addition, because the washing cover is pressed against the object be decontaminated by the operation of the suction device, it is possible to prevent excessive force from being applied to clothes. Accordingly, it is possible to remove partial contamination on delicate clothes without damage.

In accordance with another aspect of the disclosure, a washing operation may be performed by spraying washing water to the clothes and by suctioning the sprayed washing water. Accordingly, while the clothes are wet with a small amount of washing water and then dried, the contamination adhering to the clothes may be transferred to the washing water and removed. Therefore, it is possible to efficiently and effectively remove partial contamination of clothes in a short time.

In accordance with another aspect of the disclosure, the washing port may be elongated in a direction perpendicular to a washing direction, and the washing cover may include a mesh washing surface covering the washing port.

In accordance with another aspect of the disclosure, by sliding the washing cover in the washing direction, it is possible to wipe a relatively wide range of clothes. It is possible to efficiently wipe the clothes. In addition, by sliding the washing port pressed against the clothes in a state in which the washing port is covered with the mesh washing surface, it is possible to remove the contamination by rubbing the clothes. The washing effect is improved because the contamination is easily transferred to the washing water.

In accordance with another aspect of the disclosure, the washing surface may be formed in a lattice shape with a plurality of linear frames intersecting each other, and the linear frames may each be inclined with respect to the washing direction. Accordingly, even if the washing surface repeatedly slides in the washing direction, it is possible to prevent wiped marks from being left on clothes.

In accordance with another aspect of the disclosure, an area of each opening portion of the washing surface is set to be greater than or equal to 4 $mm^2$, but less than or equal to 240 $mm^2$. In response to an area of each opening portion less than 4 $mm^2$, it is difficult to appropriately wet the clothes. Conversely, in response to an area of each opening portion greater than 240 $mm^2$, the clothes may be excessively drawn into the suction pipe and the washing operation becomes difficult. Accordingly, the rubbing effect is also reduced. In both cases, the contaminant removal performance is deteriorated. By setting the area of each opening portion to be greater than or equal to 4 $mm^2$, but less than or equal to 240 $mm^2$, it is possible to prevent the above-described difficulty.

In accordance with another aspect of the disclosure, the clothes care device may be configured to perform an operation in which, in a state in which the washing cover is pressed against an object, to which the foreign substance is attached, only the suction device is operated and the suction device suctions and collects the foreign substance. The washing cover may include a first washing cover for washing in which an area of each opening portion of the washing surface is set to be greater than or equal to 4 $mm^2$, but less than or equal to 240 $mm^2$, and a second washing cover for removing foreign substances in which an area of each opening portion is greater than 240 $mm^2$. The first washing cover and the second washing cover may be interchangeable with each other according to the type of operation. Accordingly, it is possible not only to remove partial contamination of clothes but also to remove foreign substances adhering to clothes. It is possible to improve the individual operation performance by replacing the washing cover according to the operation. That is, by setting the area of the opening portion of the washing surface of the second washing cover for removing foreign substances to be greater than 240 $mm^2$, it is possible to more effectively remove the foreign substances. The foreign substance to be removed may be hair, and sebum. In response to the area of each opening portion less than or equal to 240 $mm^2$, the suction force may be weak, and the hair may be caught in the frame. In response to the area of each opening portion greater than 240 $mm^2$, the hair may be suctioned without being caught.

In accordance with another aspect of the disclosure, the clothes care device includes a washing water collection box provided separately from the washing device and forming the suction device. The washing water collection box may include an intake conduit provided to communicate with the inside of the suction pipe through a hose, an exhaust device provided in an end portion of the intake conduit and provided for exhaust, a gas-liquid separation device disposed on an upstream side of the exhaust device in the intake conduit, and a washing water collection tank detachably provided in the washing water collection box to store the washing water separated in the gas-liquid separation device. Accordingly, it is possible to collect the washing water in the washing water collection box different from the washing device. Further, the suction device may be provided separately from the washing device. Therefore, because it is possible to make the washing device compact, it becomes easy to operate the washing device.

In accordance with another aspect of the disclosure, in the clothes care device, the device body includes a small-capacity tank and a mini-pump forming the washing water supply device. The mini-pump may pressurize the washing water contained in the small capacity tank to the spray nozzle. A small amount of water may be sufficient for removing the partial contamination. Therefore, if an amount of water is sufficient for removing the partial contamination several times, the water may be mounted on the washing device operated with one hand. Accordingly, it is possible to make the washing water supply device compact by providing the washing water supply device in the washing device.

In accordance with another aspect of the disclosure, the clothes care device may be attached to a clothes care apparatus. The clothes care apparatus may be provided with a wardrobe in which a specific hanger is installed, and configured to blow air into the clothes through the hanger while the clothes are hung on the hanger. In the case of thin clothes such as a dress shirt, a fabric of the clothes overlaps each other in the state of being hung on the hanger, and thus it is difficult to suction the fabric. However, when blowing air to the inside of the clothes, the clothes swell due to the air, and thus it is easy to allow the washing cover to be in close contact with the clothes without pressing the clothes. Accordingly, workability is improved. Further, because excessive force is not applied on the clothes, it is suitable for the delicate clothes.

In accordance with another aspect of the disclosure, the clothes care apparatus includes a humidification unit configured to humidify the wardrobe and an air conditioning unit configured to condition air in the wardrobe. The clothes care device may be integrated with the clothes care apparatus and thus the washing water supply device and the suction device may be configured by using the humidification unit and the air conditioning unit. Accordingly, the main device may be shared, and thus the cost of member may be reduced.

In accordance with another aspect of the disclosure, the clothes care apparatus further includes a hanger accommodating the clothes care device, and the clothes care device may be detachable from the clothes care apparatus. Accordingly, it is possible to simply hang the clothes on the hanger to remove partial contamination, and to perform the partial contamination removal operation anywhere regardless of a location of the clothes care apparatus. Therefore, the convenience may be improved.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 5B is a table summarizing results of experiments for an effect of a size of each opening portion of a washing surface on removal of contamination or removal of foreign substances according to an embodiment of the disclosure;

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness. In addition, a front and rear, left and right, and up and down directions are based on a direction indicated by an arrow in FIG. 1.

The terms and words used in the following description and claims are not limited to the bibliographical meanings, but are merely used to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

<Configuration of Clothes Care Device, and Object to be Removed, Etc.>

Figure 1:
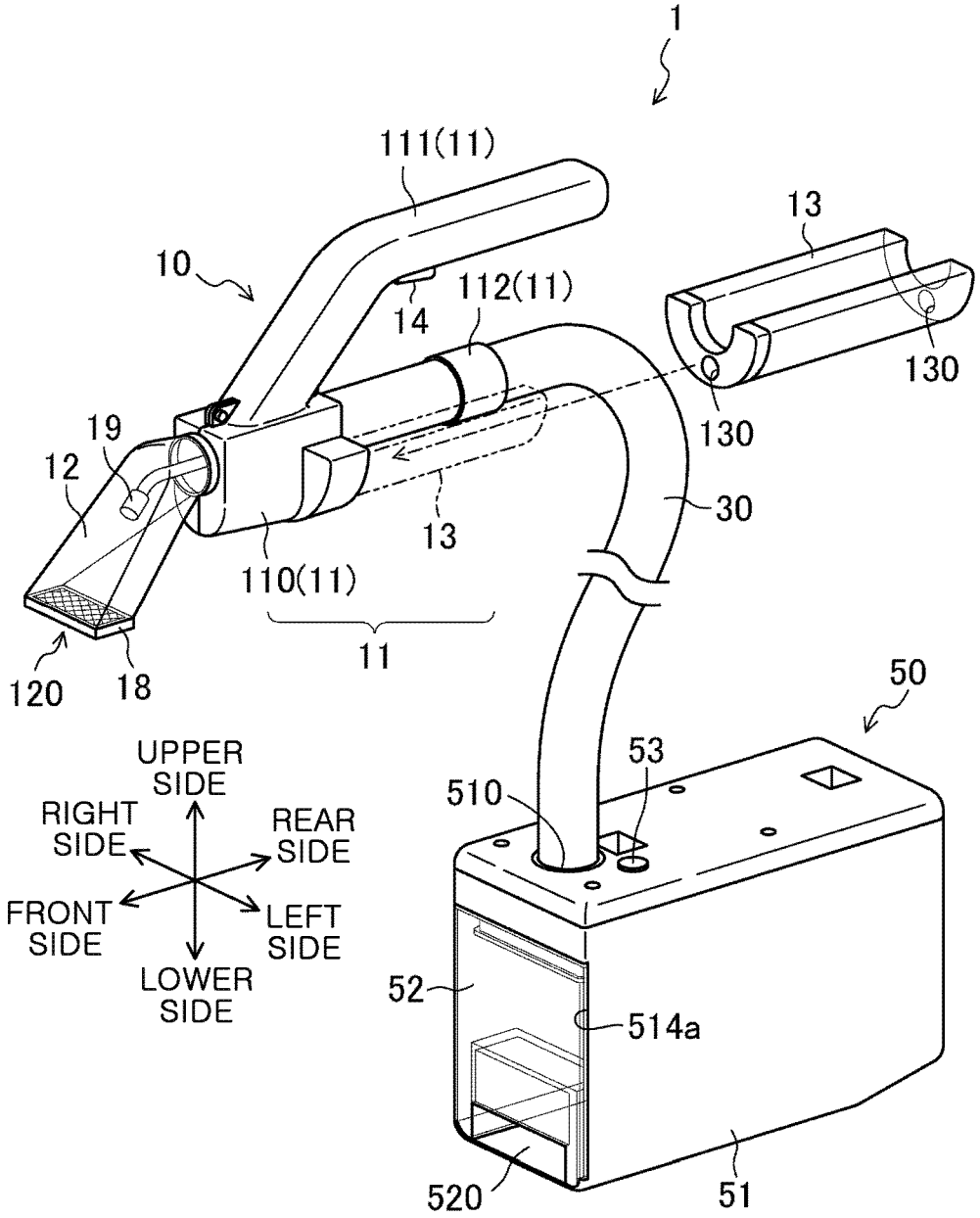
FIG. 1 is a perspective view schematically illustrating a clothes care device according to an embodiment of the disclosure.

FIG. 1 illustrates a clothes care device according to an embodiment of the disclosure.

Referring to FIG. 1, a clothes care device 1 may include a washing device 10 and a washing water collection box 50 provided separately from the washing device 10.

As for the clothes care device 1, an object to be decontaminated (target of decontamination) is clothes such as a dress shirt, a blouse, a trouser, and skirt (hereinafter, described as clothes C and shown for example in FIGS. 5A, 6, 7A, 7B, 7C, and 10). Further, the clothes care device 1 may be applicable to delicate clothes, such as clothes using wool or silk fabrics such as a suit, a jacket, a sweater, a dress, and traditional Korean clothes (hanbok), and clothes using thin fabrics. That is, as for the clothes care device 1, there is no restriction according to the type or state of the fabric. The clothes care device 1 is used for all kinds of clothes and thus the clothes care device 1 is general-purpose.

Contamination targeted by the clothes care device 1 is partial contamination in which a dirty part is locally limited to the clothes C. For example, a stain from eating, such as sauce, juice, etc., is partial contamination. For the removal of contamination of the entire clothes C, a washing machine is more suitable than the clothes care device 1.

When partial contamination is removed with the clothes care device 1, a predetermined washing operation is performed on the clothes C by holding the washing device 10. Accordingly, washing water may be sprayed onto the clothes C through a washing port 120 and the work of collecting the sprayed washing water may be simultaneously performed. As a result, the partial contamination of the clothes C may be efficiently and effectively removed in a short time.

The washing device 10 is designed to be small and light to allow a user to easily manipulate the washing device 10 with one hand. The washing water collection box 50 is also heavier than the washing device 10 but is designed to be light and compact. For example, the illustrated washing water collection box 50 has a length, a width, and a height of about 30 cm, 10 cm, and 20 cm. The washing device 10 and the washing water collection box 50 are connected by a flexible pressure-resistant hose 30.

(Washing Device 10)

As shown in FIG. 1, the washing device 10 may include a device body 11, a suction pipe 12, and a small-capacity tank 13. The device body 11 is provided with a resin molded product that is formed as a single piece. The device body 11 may include a body base 110(11) formed in a box shape, a handle 111(11), and a relay pipe 112(11). The handle 111(11) is formed in a rod shape, and the handle 111(11) may include an extended portion extending rearward from an upper surface of the body base 110(11) with respect to an upward diagonal line, and a grip portion bending downward from an upper end of the extended portion and extending rearward.

An operation switch 14 is provided in a lower side of a front-end portion of the grip portion. The operation switch 14 is provided to have an elastic force in a direction protruding outward like a trigger, and thus the operation switch 14 is turned on in response to being pressed with the finger (that is, normal open).

A user grips the grip portion with one hand, thereby operating the handle 111(11). Accordingly, the washing device 10 is designed to easily slide in the front and rear direction in a state of facing diagonally downward from the front of the washing port 120 (the front direction corresponds to a washing direction F of FIG. 2, and the rear direction is opposite thereof).

Figure 2:
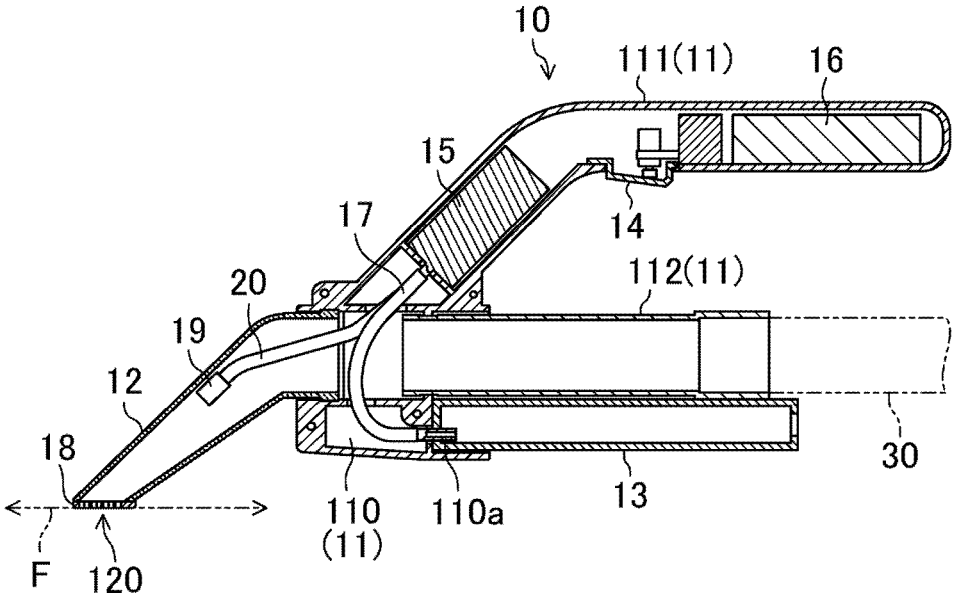
FIG. 2 is a schematic cross-sectional view of a washing device according to an embodiment of the disclosure.

FIG. 2 is a schematic cross-sectional view of a washing device according to an embodiment of the disclosure.

Referring to FIGS. 1 and 2, a small mini-pump 15 configured to be driven by a motor is installed inside the extended portion. A battery 16 configured to supply power to the mini-pump 15 or a circuit board configured to operate the mini-pump 15 according to the operation of the operation switch 14 is installed inside the grip portion. Although not shown, a plug configured to charge the battery 16 is provided at an end portion of the handle 111(11).

The relay pipe 112(11) is formed in a cylindrical shape, and extends rearward from a rear surface of the body base 110(11). One end of the pressure-resistant hose 30 is connected to a rear end of the relay pipe 112(11). The small-capacity tank 13 is provided as a small-capacity container for accommodating washing water, and provided to be removably installed to the device body 11. The small-capacity tank 13 includes a semicircular cross-section in which an inner circumferential surface is fitted to an outer circumferential surface of the relay pipe 112(11). The small-capacity tank 13 is fitted under the relay pipe 112(11) and mounted on the device body 11.

An internal capacity of the small-capacity tank 13 is designed in consideration of a weight and the number of times of treatment. For example, as for the clothes care device 1, when it is assumed that an amount of spraying water is about 50 ml for one treatment, the small-capacity tank 13 may be designed to accommodate 500 ml for being easily operated with one hand and for providing at least 10 treatments or uses. Washing water may be general water, or a solution containing a predetermined drug such as detergent or surfactant. Depending on the type of contamination, an organic solvent may be used instead of the washing water (washing solution).

A water port 130 is provided in a central portion of an arc in a width direction on a front-end surface and a rear end surface of the small-capacity tank 13. A water inlet 110*a* is provided in a lower side of the rear end of the body base 110(11), and the water inlet 110*a* is in close contact with the water port 130 through a seal member in response to the small-capacity tank 13 mounted to the device body 11. The water inlet 110*a* is connected to an inlet of the mini-pump 15 through a tube 17. The water port 130 of the rear end surface of the small-capacity tank 13 is sealed so as to be openable and closable by a cap.

The suction pipe 12 is formed of a tubular member, and an end portion thereof is mounted to the device body 11. From a front surface of the body base 110(11), the suction pipe 12 extends forward in a diagonal line to substantially parallel to the extended portion of the handle 111(11), and the washing port 120 may be opened on the front end of the suction pipe 12. The suction pipe 12 communicates with the relay pipe 112(11) through a connection chamber provided inside the body base 110(11).

A left and right width of the suction pipe 12 is formed to be greater toward a tip (end) (a shape to be wider in a rear portion). A thickness of the suction pipe 12 is formed to be less toward a tip (a shape to be narrower in a front portion). Accordingly, the washing port 120 is formed in a rectangular shape elongated in the left and right directions perpendicular to the washing direction F. The washing port 120 is equipped with a washing cover 18 that is pressed against clothes (details of the washing cover 18 will be described later).

A spray nozzle 19 configured to spray water in a radial direction is installed inside the end portion of the suction pipe 12 to face the washing port 120. The spray nozzle 19 is connected to an outlet of the mini-pump 15 through a tube 20. In response to the mini pump 15 operated, the washing water accommodated in the small-capacity tank 13 is transferred to the spray nozzle 19 and then sprayed toward the washing port 120. In the clothes care device 1, a washing water supply device is provided by the small-capacity tank 13, and the mini-pump 15.

(Washing Water Collection Box 50)

Figure 3:
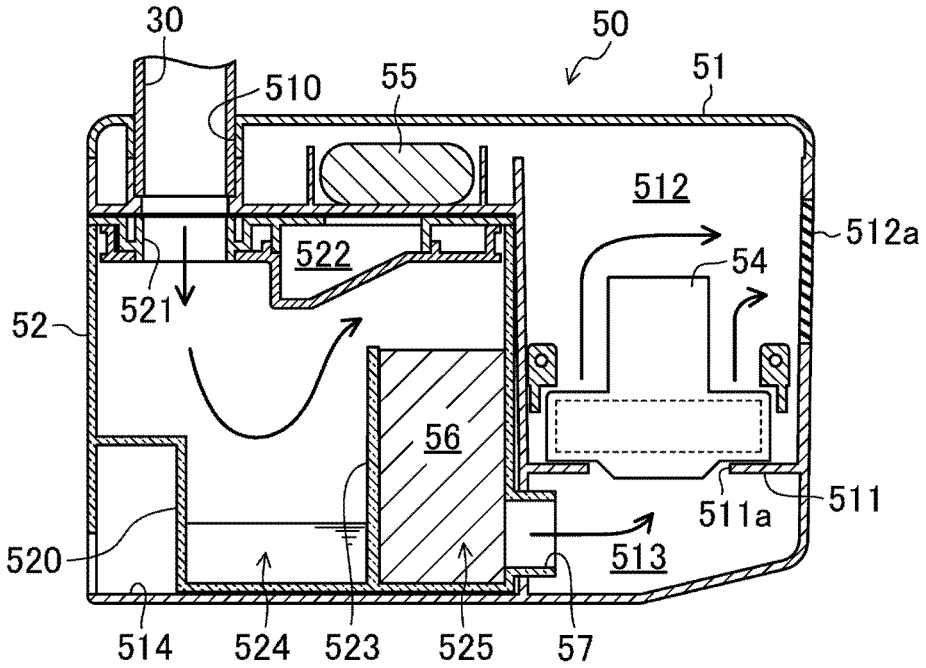
FIG. 3 is a schematic cross-sectional view of a washing water collection box according to an embodiment of the disclosure.

FIG. 3 is a schematic cross-sectional view of a washing water collection box according to an embodiment of the disclosure.

As described above, the washing water collection box 50 is provided with a box-shaped device that is lightweight, compact, and provided separately from the washing device 10.

Referring to FIGS. 1 and 3, the washing water collection box 50 may include a box body 51 formed in rectangular parallelepiped-shape elongated in the front and rear direction, and a washing water collection tank 52. The washing water collection box 50 forms a suction device configured to suction an inside of the suction pipe 12 through the pressure-resistant hose 30.

A cylindrical connection port 510, to which the other end of the pressure-resistant hose 30 is connected, is provided in a front portion of the upper surface of the box body 51. A power switch 53 is disposed in the vicinity of the connection port 510.

Referring to FIGS. 1 and 3, an exhaust chamber 512 is provided on the rear upper side of the box body 51 by dividing the inside of the box body 51 vertically with a partition wall 511. An outlet port 512*a* is formed on a rear wall of the box body 51 that partitions the rear surface of the exhaust chamber 512.

An inlet port 511*a* is opened in the partition wall 511 that partitions the bottom surface of the exhaust chamber 512. The exhaust chamber 512 communicates with a space (relay pipe 513) under the exhaust chamber 512 through the inlet port 511*a*. An electric fan 54 (or other exhaust device) is provided in the exhaust chamber 512.

In response to the electric fan 54 operated, the electric fan 54 suctions air from the inlet port 511*a* and blows the air to the exhaust chamber 512. The air blown into the exhaust chamber 512 is discharged through the outlet port 512*a*. At the back of the middle part in the front and rear direction of the upper surface of the box body 51, a battery 55 configured to supply power to the electric fan 54 or a circuit board (not shown) configured to operate the electric fan 54 according to the operation of the power switch 53 is installed.

A tank accommodating chamber 514 is formed in a lower portion of the front portion of the box body 51. The tank accommodating chamber 514 is a space for removably accommodating the washing water collection tank 52, and occupies about half of the volume of the box body 51. The washing water collection tank 52 is provided with a rectangular parallelepiped-shaped member in which an upper surface is covered with a detachable lid, and the washing water collection tank 52 may be inserted into the tank accommodating chamber 514 without a gap. As shown in FIG. 1, a tank outlet 514*a* is open on the front surface of the tank accommodating chamber 514. The washing water collection tank 52 enters and exits the tank accommodating chamber 514 through the tank outlet 514*a*.

A withdrawal groove portion 520 provided to allow a finger to be inserted thereto upon withdrawing the washing water collection tank 52 is formed in the lower front portion of the washing water collection tank 52 (a portion exposed from the box body 51). A cylindrical introduction pipe 521 vertically connected to the connection port 510 is formed in the front portion of the upper surface of the washing water collection tank 52.

A support groove portion 522 provided to allow a finger to be inserted thereto upon transporting the washing water collection tank 52 is formed in the middle portion of the upper surface of the wash water drain tank 52. A partition wall 523 provided in the middle of the lower surface of the washing water collection tank 52 so as to define a front space and a rear space. An upper end of the partition wall 523 is opposed to the bottom surface of the support groove portion 522 with a gap.

By the partition wall 523, a water storage tank 524 is formed in the front portion of the washing water collection tank 52, and a filtration tank 525 is formed in the rear portion of the washing water collection tank 52. A filter 56 is replaceably mounted to the filtration tank 525. A lead-out pipe 57 is formed in a lower portion of the rear portion of the filtration tank 525. The filtration tank 525 communicates with the relay pipe 513 through the lead-out pipe 57.

In the washing water collection box 50, an intake conduit, which is provided to allow the inside of the suction pipe 12 to communicate with the pressure-resistant hose 30 and provided to suction the inside of the suction pipe 12, is provided. Particularly, as shown by an arrow in FIG. 3, a series of conduits (intake conduit), in which the connection port 510, the introduction pipe 521, the water storage tank 524, the filtration tank 525, the lead-out pipe 57, and the relay pipe 513 and the exhaust chamber 512 are sequentially arranged from the upstream side, is formed inside the washing water collection box 50. As the connection port 510, the introduction pipe 521, the water storage tank 524, the filtration tank 525, the lead-out pipe 57, and the relay pipe 513 and the exhaust chamber 512 are arranged without a gap, and in response to the electric fan 54 operated, which is arranged in the exhaust chamber 512 positioned on the end of the intake conduit, an inside of the intake conduit in the upstream side than the electric fan 54 is suctioned and a pressure thereof is reduced.

Washing water, which is contained in air that is suctioned from the suction pipe 12, may be separated in the wash water collection tank 52. That is, the suctioned gas-liquid is introduced into the water storage tank 524 from the vertical direction downward through the connection port 510 and the introduction pipe 521. Thereafter, the gas-liquid flows upward in the vertical direction and flows into the filtration tank 525 through a gap opened between the bottom surface of the support groove portion 522 and the partition wall 511. At this time, the washing water is separated and stored in the water storage tank 524 according to the difference in specific gravity. Only air flows into the filtration tank 525. The washing water collection tank 52 forms a gas-liquid separation device.

(Washing Cover 18)

As described above, the washing cover 18 pressed against the clothes C is mounted to the washing port 120. The clothes care device 1 includes a first washing cover for washing to remove partial contamination of the clothes C, and a second washing cover to remove foreign substances attached to the clothes C.

Figure 4A:
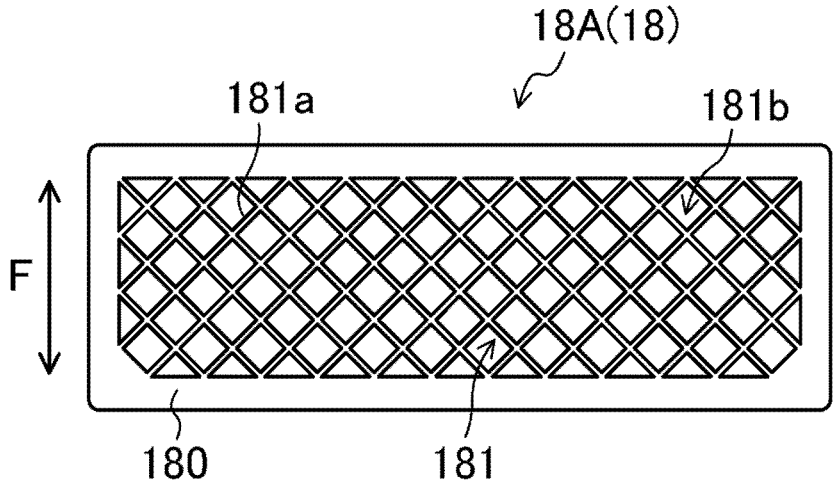
FIG. 4A is a schematic view illustrating an example of a first washing cover used to remove partial contamination according to an embodiment of the disclosure.

FIG. 4A illustrates an example of the first washing cover 18A(18) according to an embodiment of the disclosure.

Figure 4B:
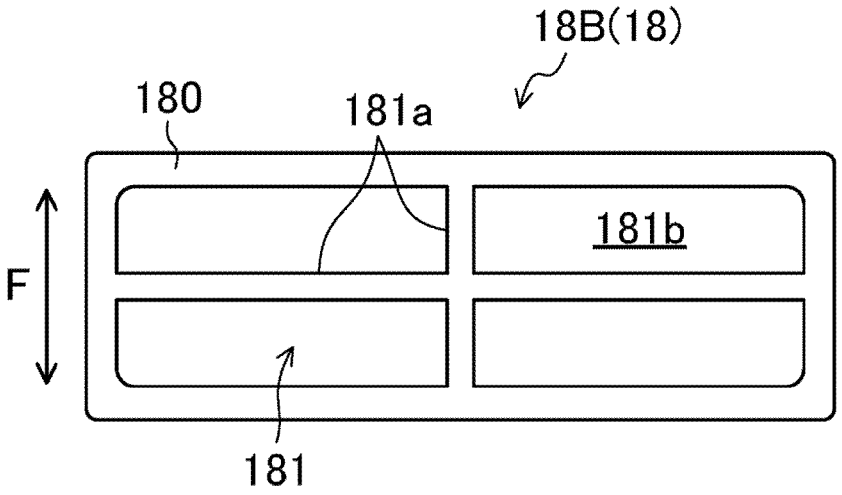
FIG. 4B is a schematic view illustrating an example of a second washing cover used to remove foreign substances according to an embodiment of the disclosure.

FIG. 4B illustrates an example of the second washing cover 18B(18) according to an embodiment of the disclosure.

Referring to FIGS. 4A and 4B, the washing covers 18A(18) and 18B(18) may include a mounting frame 180 formed in a rectangular shape that corresponds to a shape of the washing port 120, and a washing surface 181 formed in a mesh structure, provided to spread inside the mounting frame 180 and replaceably mounted to the washing port 120. In response to the mounting frame 180 mounted to an outer circumference of the washing port 120, the washing port 120 is covered with the washing surface 181.

As described above, the handle 111(11) is designed to allow the washing cover 18 to be slidable in the front and rear direction (washing direction F) in a state in which the washing cover 18 is pressed against the clothes C upon operating the washing device 10. In addition, the washing cover 18 and the washing port 120 are elongated in a direction perpendicular to the washing direction F. Accordingly, by sliding the washing cover 18 in the washing direction F, it is possible to wipe off a relatively wide range of the clothes C.

The washing cover 18 is formed of a plastic resin so as to form a flat plate shape that is not substantially deformed unlike a flexible net. That is, the washing surface 181 fixed to the mounting frame 180 is almost flat so as to be brought into close contact with the clothes C.

For example, as for the washing surface 181 having a curved shape that is convex outward from the mounting frame 180, a gap may be generated between the peripheral portion of the washing surface 181 and the clothes C, and thus during the washing operation, air may be introduced through the gap. In the case of the almost flat washing surface 181, the gap may not be generated. Alternatively, the washing surface 181 may be a curved shape slightly concave inward. In this case, a gap may not be generated between the peripheral portion of the washing surface 181 and the clothes C.

Further, the washing cover 18 has rigidity not to be curved or bent during normal use. Accordingly, the positional relationship between the washing surface 181 with which the clothes C is in close contact and the spray nozzle 19 may be constantly maintained. Although details will be described later, such a positional relationship is important to obtain an effective washing performance. During the washing operation, an optimal positional relationship may not be maintained due to the deformation of the washing cover 18.

Because the washing port 120 is covered with the mesh washing surface 181, it is possible to remove the contamination by rubbing a region, which is to be wiped, of the clothes C by sliding the washing port 120 in a state of being pressed against the clothes C. Rather than compressing the clothes C to the washing port 120 by pressing strongly on the table, etc., the washing port 120 slides in the state of being pressed on the clothes C by a suction force and thus an excessive load is not applied to a fabric of the clothes C. Accordingly, it is possible to effectively wipe off even delicate clothes.

Referring to FIG. 4A, the washing surface 181 of the first washing cover 18A(18) includes a plurality of linear frames 181*a* crossing each other in a lattice shape. The linear frames 181*a* are each designed to be inclined with respect to the washing direction F.

FIG. 5 A is a view illustrating a problem in a washing operation according to an embodiment of the disclosure.

Figure 5A:
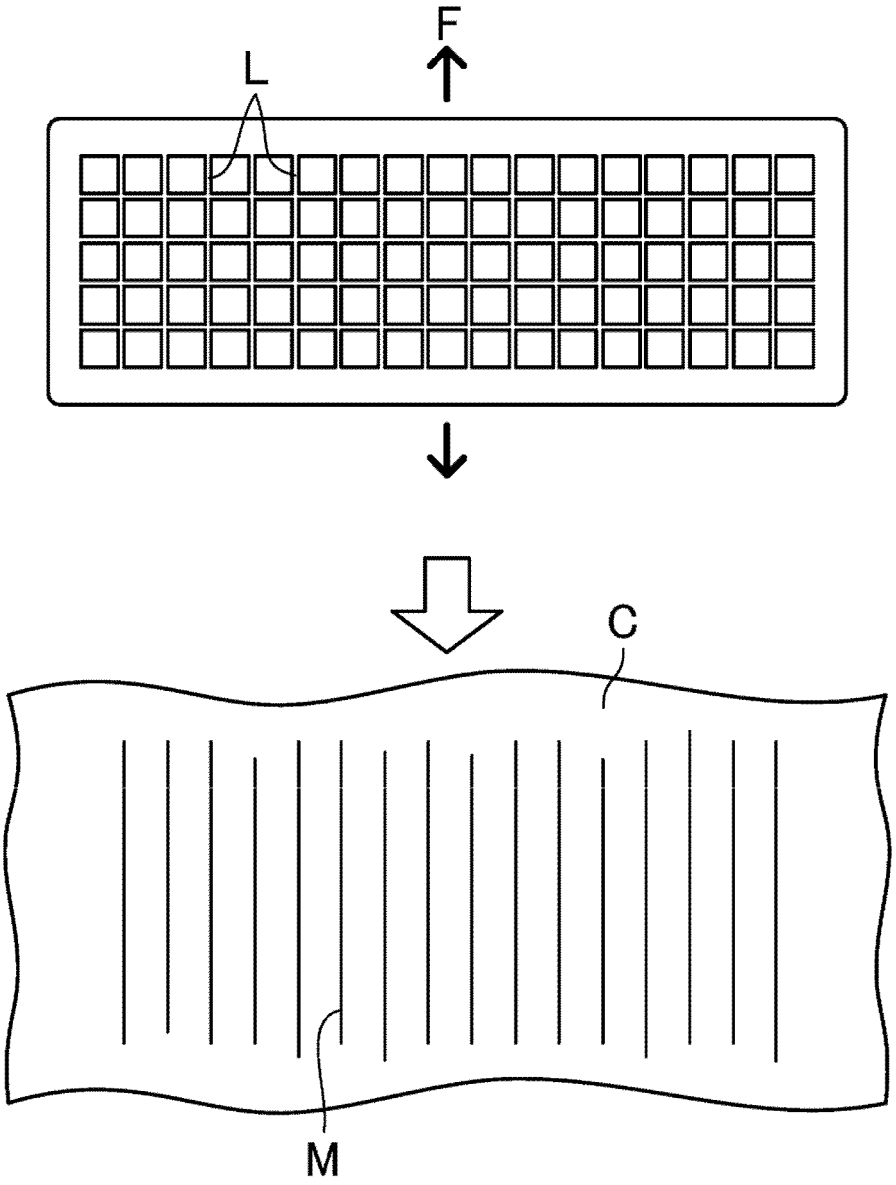
FIG. 5A is a view illustrating a problem in a washing operation according to an embodiment of the disclosure.

In the case of designing the lattice washing surface 181, it is common to include a rectangular mesh shape parallel and perpendicular to the washing direction F, as illustrated in an upper drawings of FIG. 5A. However, in a state in which the mesh is formed in this way, when linear frames repeatedly slide in the washing direction F, a portion of the clothes C in contact with the linear frame (indicated by a symbol "L" in FIG. 5A) parallel to the washing direction F may be always compressed. Therefore, after the washing operation, a washing mark M in the form of multiple-lines may be left on the clothes C, as illustrated in a lower drawings of FIG. 5A.

In the clothes care device 1, because the linear frames 181*a* are inclined with respect to the washing direction F, respectively, when the linear frames 181*a* repeatedly slide in the washing direction F, a portion of the clothes C in contact with the linear frames 181*a* may be dispersed. Accordingly, the washing marks M are not left on the clothes C, and it is possible to uniformly wipe the washing portion of the clothes C.

In addition, a shape of each opening portion 181*b* of the mesh washing surface 181 (an eye portion of the mesh shape) is not limited to a rectangle. Therefore, the opening portion 181*b* may be a circular or a polygonal shape, and the size thereof may vary. The opening portions 181*b* having different sizes (large and small) may be formed.

FIG. 5B is a table summarizing results of experiments for an effect of a size of each opening portion of a washing surface on removal of contamination or removal of foreign substances according to an embodiment of the disclosure.

Further, as for the first washing cover 18A(18), an area of each opening portion 181*b* of the washing surface 181 is set to be greater than or equal to 4 $mm^2$, but less than or equal to 240 $mm^2$.

Referring to FIG. 5B, the table illustrates the results of experiments with respect to the size of the opening portion 181*b* of the washing surface 181, respectively, for the removal of partial contamination and the removal of attached foreign substances. "○" indicates desirable results and "X" indicates undesirable results.

In a state in which an area of each opening portion 181*b* is less than 4 $mm^2$, when the washing water is sprayed, the transmittance of the washing water droplets to the washing surface 181 is reduced, and thus it is difficult to appropriately wet the clothes C. Conversely, in response to an area of each opening portion 181*b* greater than 240 $mm^2$, the clothes C is excessively drawn into the suction pipe 12 and the washing operation becomes difficult. Accordingly, the washing effect is also reduced. In both cases, the contaminant removal performance is deteriorated.

By setting the area of each opening portion 181*b* to be greater than or equal to 4 $mm^2$, but less than or equal to 240 $mm^2$, it is possible to prevent the above-described difficulty. Therefore, it is possible to effectively remove the partial contamination attached to the clothes C.

Accordingly, referring to FIG. 4B, the washing surface 181 of the second washing cover 18B(18) is formed in a normal lattice shape composed of linear frames 181*a* perpendicular to each other, and an area of each opening portion 181*b* is set to be greater than 240 $mm^2$.

The foreign substance to be removed may be hair, and sebum. In response to the area of each opening portion 181*b* set to be less than or equal to 240 $mm^2$, the suction force is weak, and the hair is caught in the linear frame 181*a*. Therefore, foreign substances may not be suctioned. In response to the area of each opening portion 181*b* set to be greater than 240 $mm^2$, the hair may be suctioned without being caught. By providing the linear frame 181*a* in a lattice shape, it is possible to strengthen the washing cover 18 to prevent damage. Further, the shape and size of the mesh is not limited to the illustrated example.

<Operation, Function, Etc. of the Clothes Care Device>

The clothes care device 1 is configured to select and perform any one of an operation of washing and removing a partial contamination of the clothes C and an operation of suctioning and removing foreign substances adhering to the clothes C. This operation and function of the clothes care device 1 will be described in detail with reference to FIGS. 6 to 8.

Figure 6:
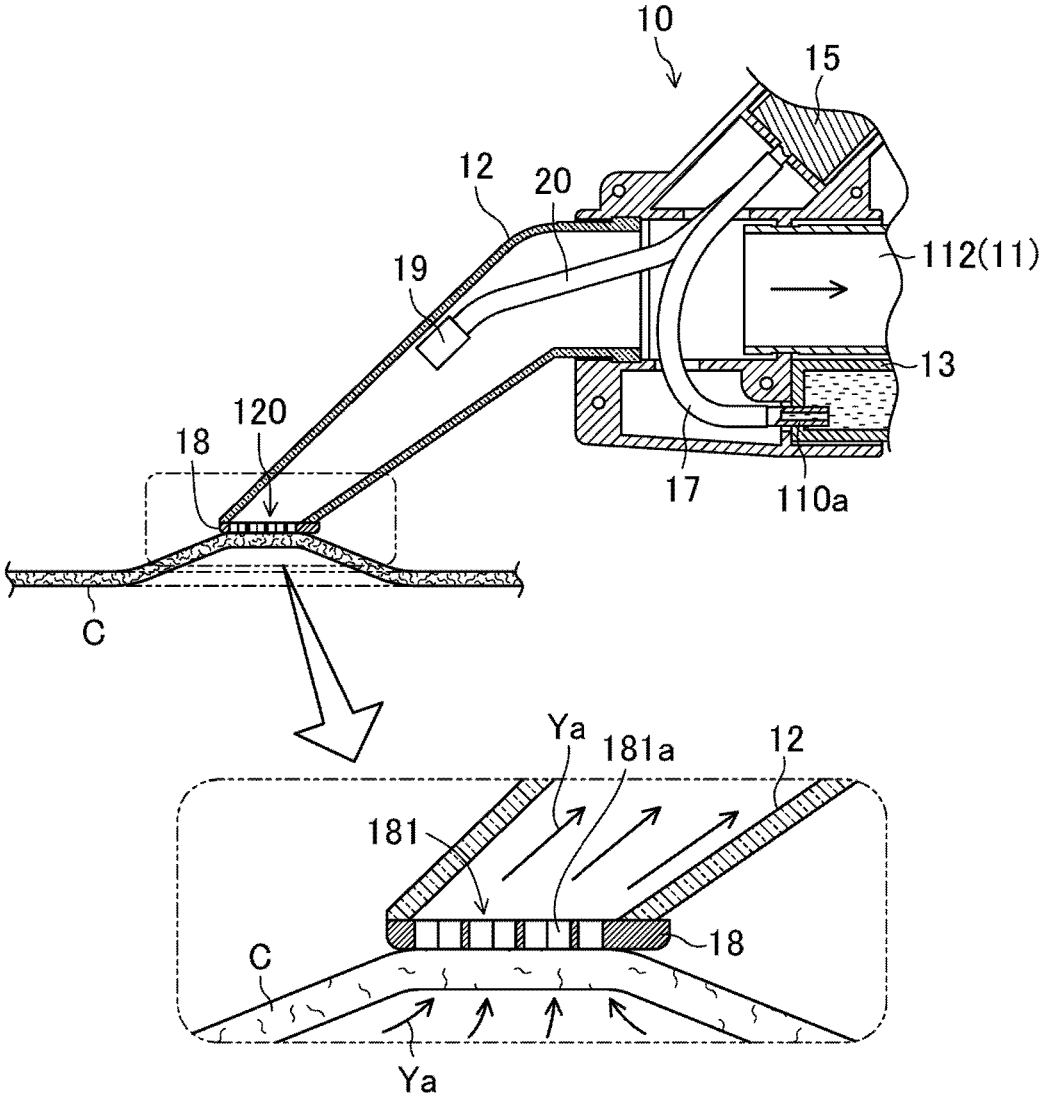
FIG. 6 is a view illustrating functions of both a partial contamination removal operation and a foreign substance removal operation according to an embodiment of the disclosure.

FIG. 6 is a view illustrating functions of both a partial contamination removal operation and a foreign substance removal operation according to an embodiment of the disclosure.

Figure 7A:
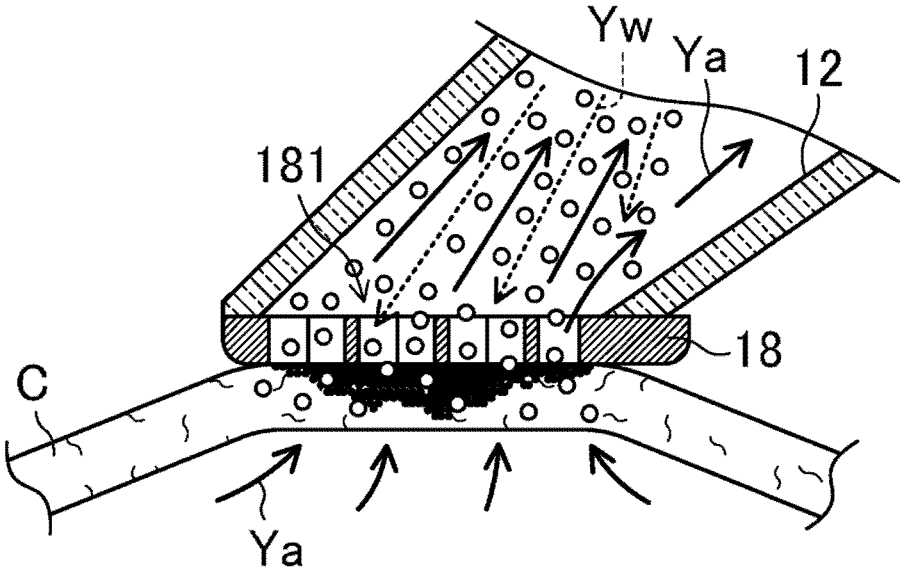
FIG. 7A is a view illustrating a function of a partial contamination removal operation according to an embodiment of the disclosure.

FIG. 7A is a view illustrating a function of partial contamination removal operation according to an embodiment of the disclosure.

Figure 7B:
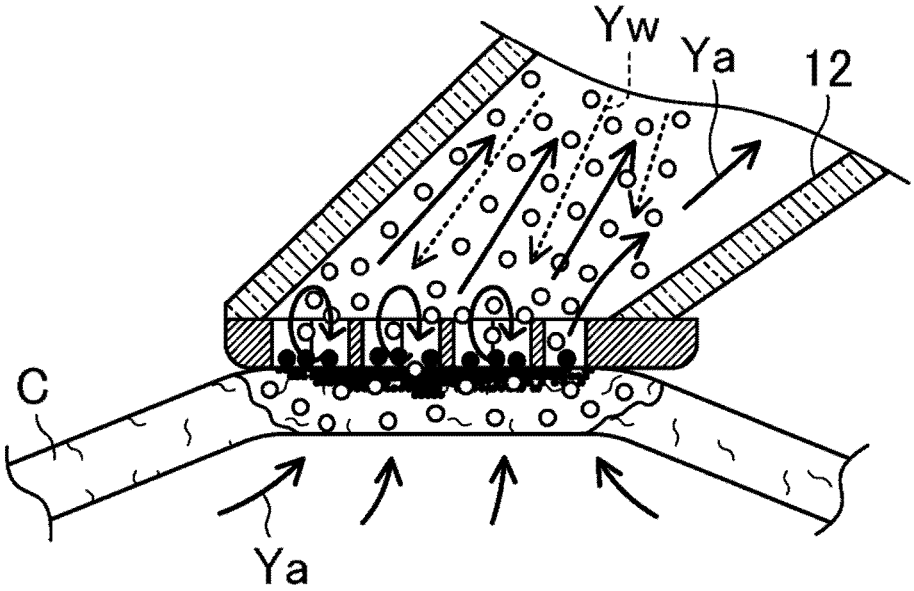
FIG. 7B is another view illustrating a function of a partial contamination removal operation according to an embodiment of the disclosure.

FIG. 7B is another view illustrating a function of a partial contamination removal operation according to an embodiment of the disclosure.

Figure 7C:
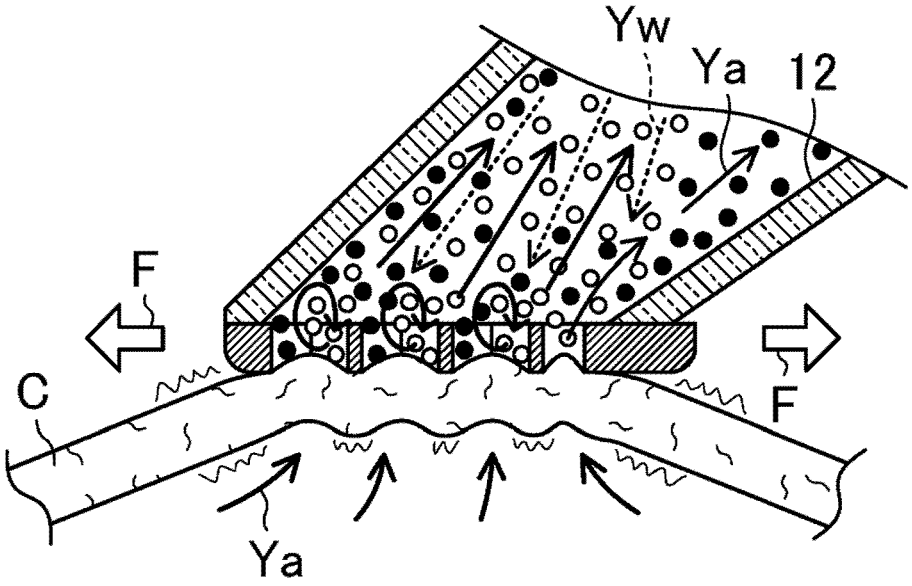
FIG. 7C is another view illustrating a function of a partial contamination removal operation according to an embodiment of the disclosure.

FIG. 7C is another view illustrating a function of a partial contamination removal operation according to an embodiment of the disclosure.

Figure 8:
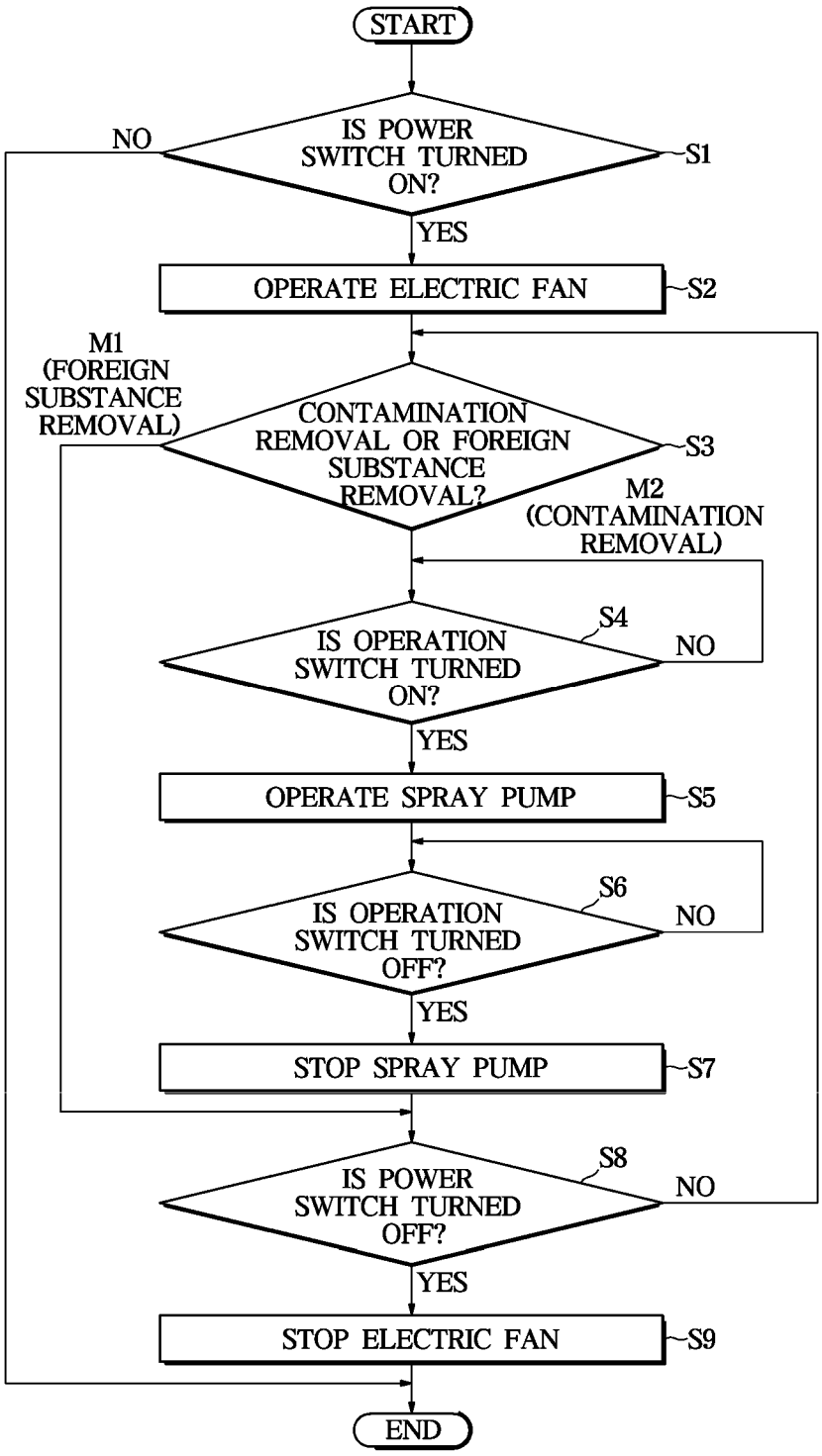
FIG. 8 is a flow chart illustrating an example of a main operation flow of a clothes care device according to an embodiment of the disclosure.

FIG. 8 is a flow chart illustrating an example of a main operation flow of a clothes care device according to an embodiment of the disclosure.

Referring to FIGS. 6 to 8, a user charges each battery 16 and 55 in advance. The washing cover 18 is replaced with one corresponding to the work to be executed. In addition, the user supplies a sufficient amount of washing water into the small-capacity tank 13 when the partial contamination removal operation is performed. Accordingly, at any place, the partial contamination removal operation may be performed multiple times without replenishment of the washing water.

The user turns on the power switch 53 on the upper surface of the washing water collection box 50 at operation S1. Accordingly, the electric fan 54 is operated to suction air from the washing port 120 at operation S2. In response to the washing cover 18 brought into contact with the surface of the clothes C, the clothes C is drawn to the washing surface 181 as shown in FIG. 6. Particularly, as indicated by an arrow Ya in FIG. 6, air escapes from the inside of the clothes C to the surface. At this time, the clothes C is drawn according to the air resistance of the clothes, and pressed against the washing surface 181.

The user determines whether to perform the partial contamination removal operation or foreign substance removal operation at operation S3.

Based on performing the foreign substance removal operation M1 in operation S3, the user grips the handle 111(11) and performs the washing operation by manipulating the washing device 10. That is, in the foreign substance removal operation, only the electric fan 54 may be operated in the state in which the washing cover 18 (the second washing cover 18B(18)) is pressed against the clothes C. Accordingly, foreign substances are suctioned by the electric fan 54 and collected in the washing water collection box 50.

In the foreign substance removal operation, it is not required to press the washing surface 181 to the clothes C. Even when pressing the washing surface 181, the number of the linear frame 181*a* is small because the area of the opening portion 181*b* is large, and the clothes C is not wet, and thus it is possible to prevent the washing mark M from being left on the clothes C.

Foreign substances, such as hair, which are attached to the surface of the clothes C, are suctioned into the suction pipe 12 through the washing port 120 together with air, and then introduced into the washing water collection box 50. Foreign substances having heavy specific gravity, such as a clip, are accommodated in the water storage tank 524. Foreign substances having light specific gravity, such as hair, are filtered out by the filter 56 in the filtration tank 525 and then removed.

In response to the foreign substance removal operation completed, the user turns off the power switch 53 at operation S8, and the electric fan 54 is stopped at operation S9.

Further, based on performing the partial contamination removal operation M2 in operation S3, the user appropriately turns on the operation switch 14 for the washing operation at operation S4. Accordingly, the mini-pump 15 is operated to pump the washing water from the small-capacity tank 13 to the spray nozzle 19, and then the washing water is sprayed from the spray nozzle 19 toward the washing port 120 at operation S5.

That is, in the partial contamination removal operation, the mini-pump 15 is operated while the washing cover 18 (the first washing cover 18A(18)) is pressed against the clothes C by the operation of the electric fan 54. Accordingly, the washing water is sprayed to a washing region, in which partial contamination is placed, of the clothes C, and the washing water is suctioned by the electric fan 54 and then collected to the washing water collection box 50.

As indicated by an arrow Yw referring to FIG. 7A, by setting a spraying force of the washing water to be greater than a suction force, the droplets of washing water may be scattered toward the washing port 120. The droplets of washing water pass through the washing port 120 and collides with the clothes C. Accordingly, the propulsion energy is lost, and the droplets of washing water adhere to the clothes C, and the clothes C become wet. As the clothes C becomes wet, the contamination of the clothes C is transferred from the clothes C to the washing water. The water droplets, which do not adhere to the clothes C, are suctioned and are collected to the washing water collection tank 52.

Referring to FIGS. 4A, 4B, and 7B, a fine vortex is generated in the vicinity of the washing surface 181. That is, a fine vortex is generated in each of the opening portions 181*b* by the interaction of the flows in opposite directions to each other and passing through each opening portion 181*b* according to the spraying force and the suction force of the washing water. Due to the action of the vortex, the contamination adhering to the clothes C is more likely to be transferred to the washing water, and the contaminated washing water is more likely to be suctioned.

Because the vortex is formed according to the balance between the spraying force and the suction force of the washing water, when the spray nozzle 19 is disposed in the vicinity of the washing port 120, the balance between the spraying force and the suction force is broken, thereby preventing the generation of the vortex. Therefore, it is appropriate to arrange the spray nozzle 19 at a position apart from the washing port 120 by a predetermined distance.

In addition, in a state in which the clothes C is pressed against the mesh washing surface 181, the washing operation, in which the washing surface 181 repeatedly slides along the washing direction F, is performed, as shown in FIG. 7C. Therefore, it is possible to obtain an effect in which the clothes C is properly rubbed to remove contamination. Accordingly, the contamination is more likely to be transferred to the washing water, and the contaminated washing water is also more likely to be suctioned. By the action, the performance of the contaminant removal is improved.

In addition, in response to strongly pressing the washing surface 181, the delicate clothes C may be easily torn and the shape thereof may be easily destroyed. However, as for the clothes care device 1, an excessive force is not applied to the clothes C because the clothes C is drawn and compressed by the suction force. Therefore, it is possible to appropriately and effectively remove partial contamination in the clothes C using a delicate fabric.

In response to the operation switch 14 turned off at operation S6, that is, when a finger is released from the operation switch 14, the mini-pump 15 stops at operation S7. Accordingly, because the washing water is not sprayed, only suction is performed. In the meantime, the wet clothes C is rapidly dried by air passing through the clothes C.

In the state of the power switch 53 being turned on, 'No' in operation S8, a user appropriately turns on and off the operation switch 14 at operations S4 and S6 while performing the washing operation, until the partial contamination removal is completed. In response to the completion of the partial contamination removal, the user turns off the power switch 53, 'Yes' in operation S8, and the electric fan 54 stops at operation S9.

<Application Example of Clothes Care Device>

It is appropriate that the clothes care device is attached to a clothes care apparatus with functions of clothes wrinkle removal. First and second application examples are described below.

First Application Example

Figure 9:
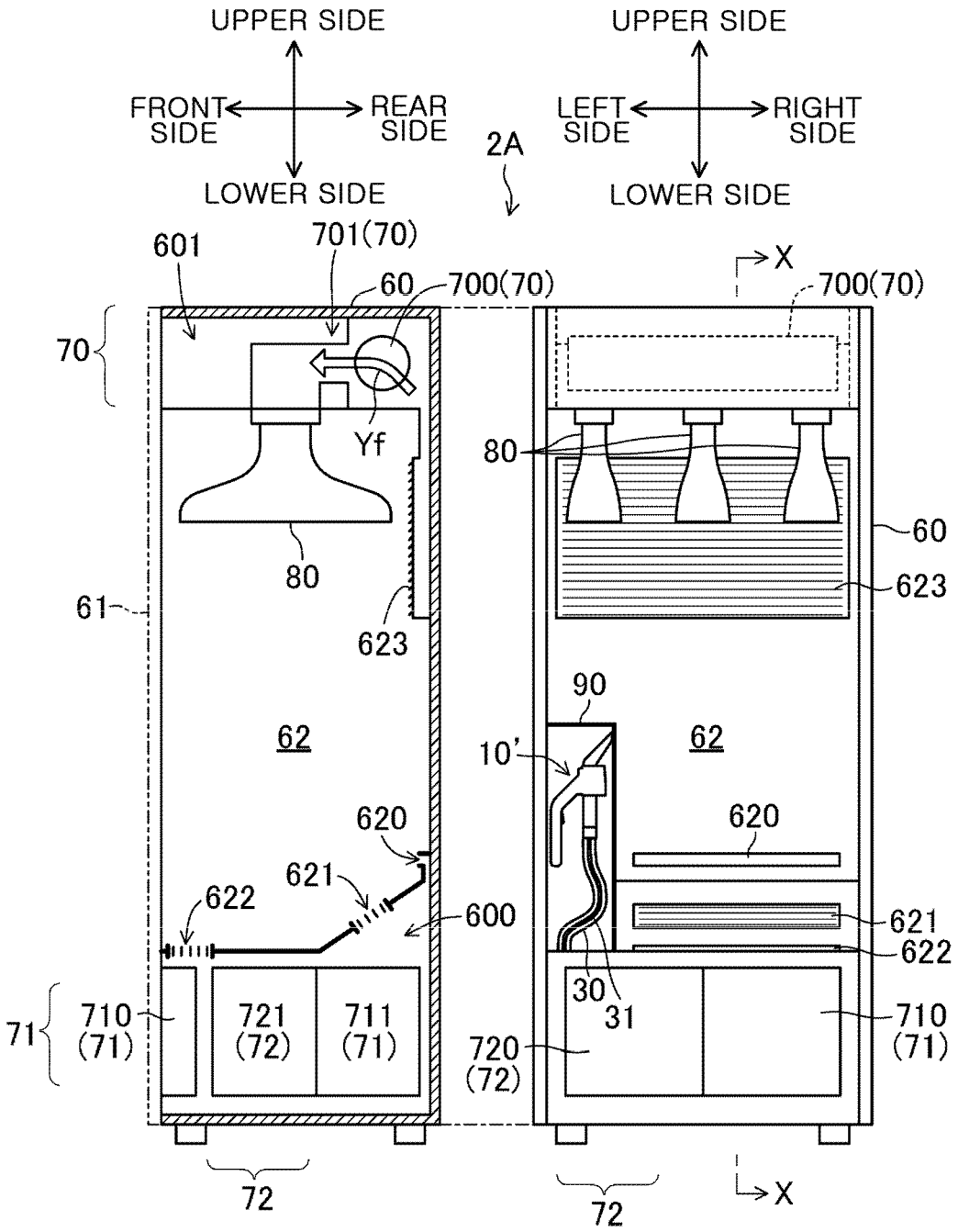
FIG. 9 is a schematic view illustrating a structure of a first application example of a clothes care device, particularly a left drawing is a schematic cross-sectional view taken along line X-X of a right drawing according to an embodiment of the disclosure.

FIG. 9 illustrates a structure of a clothes care apparatus according to an application example according to an embodiment of the disclosure. For example, a clothes care apparatus 2A is installed in a changing room, a bathroom, etc., and is used for wrinkle removal of clothes (tops), such as a jacket and a shirt.

Referring to FIG. 9, the clothes care apparatus 2A includes a function of humidifying the clothes C or blowing the conditioned air to the inside of the clothes C through a hanger 80 in a state in which the clothes C is hung on the hanger 80.

The clothes care apparatus 2A is formed in the shape of a vertically long box. The clothes care apparatus 2A includes a housing 60 including an open front and a door 61 rotatably coupled to the housing 60 to open and close a front surface of the housing 60. A wardrobe 62 accommodating the clothes C is formed inside the clothes care apparatus 2A.

A lower space 600 is provided in a lower portion of the housing 60. An upper space 601 is provided in an upper portion of the housing 60. A blowing unit 70 is provided in the upper space 601. A humidification unit 71 and an air conditioning unit 72 are installed in the lower space 600. The wardrobe 62 is defined between the lower space 600 and the upper space 601. The hanger 80 is mounted in an upper portion of the wardrobe 62. The clothes care apparatus 2A is configured to allow three hangers 80 to be mounted thereto, but embodiments are not limited thereto.

A steam outlet 620, an air outlet 621, and an air inlet 622 are formed on a bottom surface of the wardrobe 62. The humidification unit 71 may include a water supply tank 710(71), and a steam generator 711(71). The air conditioning unit 72 may include a drain tank 720(72), and a heat exchanger 721(72). The humidification unit 71 is configured to humidify the wardrobe 62. The air conditioning unit 72 is configured to condition air of the wardrobe 62.

The drain tank 720(72) and the water supply tank 710(71) are disposed in a front portion of the lower space 600. The drain tank 720(72) and the water supply tank 710(71) are detachable from the housing 60. The water stored in the water supply tank 710(71) is transferred to the steam generator 711(71). The steam generator 711(71) generates steam by heating water with a heater.

Steam generated by the humidification unit 71 is supplied to the wardrobe 62 through the steam outlet 620. Steam is diffused in the wardrobe 62 by the wind generated by the air conditioning unit 72.

The air conditioning unit 72 suctions air of the wardrobe 62 through the air inlet 622 and conditions a temperature and a humidity of the air. The air conditioning unit 72 blows out the conditioned air to the wardrobe 62 through the air outlet 621. As the air conditioning unit 72 is operated, dry warm air is blown into the wardrobe 62. Water discharged from the air conditioning unit 72 is stored in the drain tank 720(72).

The blowing unit 70 may include a blowing fan 700(70), and a blowing duct 701(70). The blowing fan 700(70) is installed inside the blowing duct 701(70). In response to the blowing fan 700(70) operated, the air of the wardrobe 62 is suctioned into the blowing duct 701(70) from a ventilation hole 623 disposed on a rear surface of the wardrobe 62. Accordingly, a flow (wind) of air indicated by an arrow Yf in FIG. 9 is formed. The wind is blown into the clothes C through the hanger 80 referring to FIG. 10.

Figure 10:
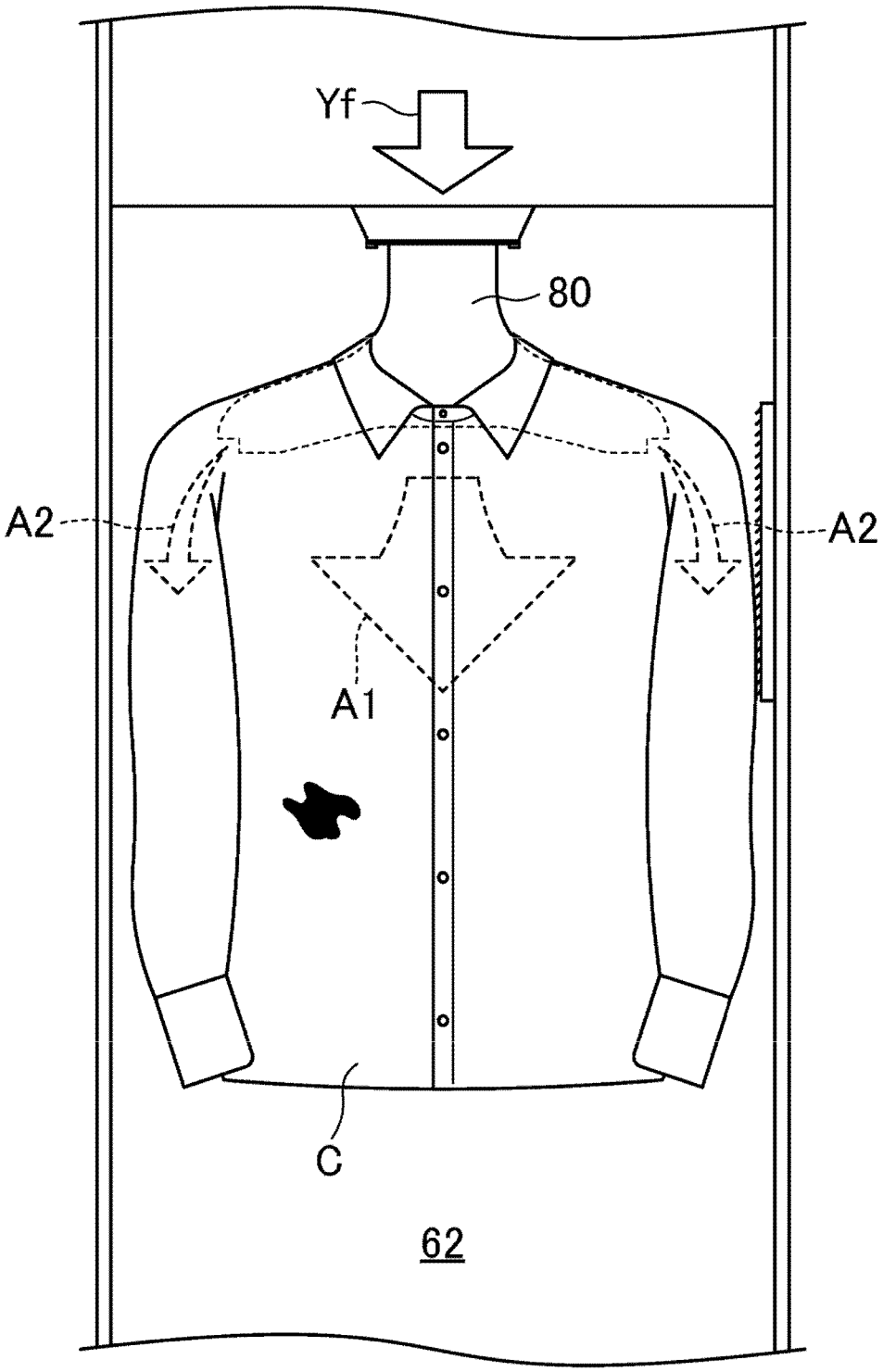
FIG. 10 is a schematic view illustrating a state in which air flows in clothes according to an embodiment of the disclosure.

FIG. 10 is a schematic view illustrating a state in which air flows in clothes according to an embodiment of the disclosure.

Referring to FIG. 10, the hanger 80 is provided with a resin molded product including a hollow, and detachably mounted to the upper portion of the wardrobe 62. Inside the hanger 80, a body-side ventilation path provided to blow wind toward a body portion of the clothes C and a pair of sleeve-side ventilation paths provided to blow wind toward a sleeve portion of the clothes C are formed. Through such a ventilation path, air is blown to the body portion and sleeve portion of the clothes C, as indicated by arrows A1 and A2 in FIG. 10. Accordingly, the body portion and the sleeve portion of the clothes C swell and flap. As a result, it is possible to effectively unfold the wrinkles in the clothes C.

(Wrinkle Removal Operation)

After a user hangs the clothes C on the hanger 80 and closes the door 61, the user starts the wrinkle removal operation. Accordingly, the humidification unit 71 is operated to generate steam in the wardrobe 62. Further, the air conditioning unit 72 is operated to circulate the air in the wardrobe 62. When the predetermined time elapses, the clothes C may become appropriately wet.

In response to the operation of the humidification unit 71 stopped, the air conditioning unit 72 dries the air circulating in the wardrobe 62. The blowing unit 70 is also operated to blow air from the wardrobe 62 into the clothes C through the hanger 80. Accordingly, the clothes C is gradually dried while swelling and flapping. As a result, wrinkles on the clothes C are effectively removed. When the predetermined time elapses and the clothes C is dried, the wrinkle removal operation is completed.

(Attachment of Clothes Care Device)

In the case of the clothes care apparatus 2A according to the application example, the clothes care device is provided integrally with the clothes care apparatus 2A, and the washing water supply device and the suction device are configured with the humidification unit 71 and the air conditioning unit 72.

That is, referring to FIG. 9, a storage case 90 is provided at a lower corner of the wardrobe 62, and a washing device 10' is accommodated therein. In the washing device 10', the small-capacity tank 13 and the battery 16 are omitted from the washing device 10 of the clothes care device 1 according to the above-described embodiment. Therefore, the washing device 10' is more lightweight.

However, an electric cable (not shown) connected to a circuit board together with the pressure-resistant hose 30 and a water supply tube 31 connected to the inlet of the mini-pump 15 are placed inside the lower space 600 through the bottom surface the wardrobe 62. The electric cable is connected to an electric system of the clothes care apparatus 2A.

The water supply tube 31 is connected to the humidification unit 71, and a washing water supply device configured to supply washing water to the spray nozzle 19 is configured with the humidification unit 71. The pressure-resistant hose 30 is connected to the air conditioning unit 72, and a suction device configured to suction the inside of the suction pipe 12 is configured with the air conditioning unit 72. Because the main device is shared, it is possible to reduce the cost of subsidiary materials.

(Partial Contamination Removal, and Foreign Substance Removal Operation)

In a state in which a user hangs the clothes C on the hanger 80 and opens the door 61, the user starts the partial contamination removal, or the foreign substance removal operation. Accordingly, an inside of the suction pipe 12 is in a suctioned state. The user operates the washing device 10' to press or close the second washing cover 18B(18) to the clothes C to perform the foreign substance removal operation.

Based on performing the partial contamination removal operation, a user operates the washing device 10' so as to compress the first washing cover 18A(18) against the clothes C, thereby performing the washing operation, and the user turns on and off the operation switch 14. Accordingly, the washing water is sprayed, and it is possible to perform the removal operation of the partial contamination of the clothes C, such as a stain shown in FIG. 10. In this case, it is appropriate to use hot water by heating the washing water through the humidification unit 71.

Further, in this case, because the washing device 10' is attached to the clothes care apparatus 2A, it is possible to blow air to the inside of the clothes C through the operation of the blowing unit 70.

In the case of thin clothes C such as a dress shirt, a fabric of the clothes overlaps each other in the state of being hung on the hanger 80, and thus it is difficult to suction the fabric. However, when blowing air to the inside of the clothes C, the clothes C swells due to the air, and thus it is easy to allow the first washing cover 18A(18) to be in close contact with the clothes C without pressing the clothes. Accordingly, workability is improved. Further, because excessive force is not applied on the clothes C, it is suitable for the clothes C of delicate fabric.

Second Application Example

Figure 11:
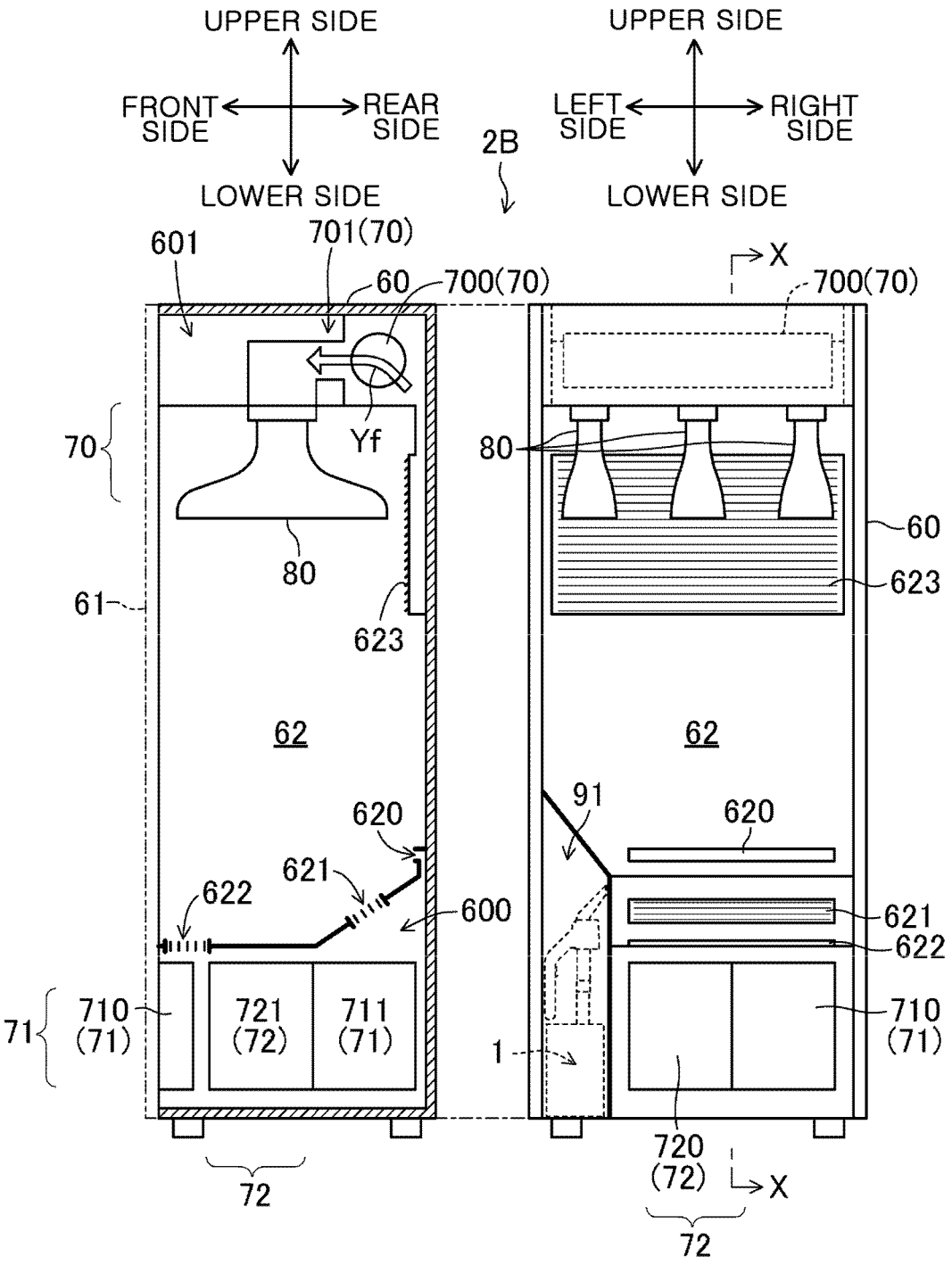
FIG. 11 is schematic view illustrating a second application example of a clothes care device (a view corresponding to FIG. 9) according to an embodiment of the disclosure.

FIG. 11 illustrates a structure of a clothes care apparatus according to an embodiment of the disclosure.

Referring to FIG. 11, a basic configuration of a clothes care apparatus 2B is the same as that of the clothes care apparatus 2A according to the first application example.

In the first application example, the clothes care device is provided integrally with the clothes care apparatus 2A, but in the second application example, the clothes care device is detachably installed to the clothes care apparatus 2B.

That is, at a lower corner of the clothes care apparatus 2B, a hanger 91 is provided by dividing the inside of the clothes care apparatus 2B, as shown in FIG. 11. The clothes care device 1 shown in the above-described embodiment is housed in the hanger 91. That is, the clothes care device 1 is provided separately from the clothes care apparatus 2B, and thus the clothes care device 1 may be accommodated in the clothes care apparatus 2B.

In this case, the partial contamination removal operation may be performed on the clothes C hung on the hanger 80 in the same manner as the first application example, and further, the partial contamination removal operation may be performed anywhere regardless of the location of the clothes care apparatus 2B.

In this case, in the hanger 91, it is appropriate to provide a charging plug configured to charge the batteries 16 and 55 of the clothes care device 1. Accordingly, because it is possible to charge each of the batteries 16 and 55 in a state in which the clothes care device 1 is stored in the hanger 91, it is possible to prevent an accident such as lack of charging.

The disclosed technology is not limited to the above-described embodiment, and may include various other configurations.

For example, in the above-described embodiment, the clothes care device 1 composed of the washing device 10 and the washing water collection box 50 is exemplified. However, the washing device 10 may include a suction device and thus it is possible to omit the washing water collection box 50. It may cause a reduction in a tank capacity or it may cause an enlargement of the washing device 10, but it is possible to make the entire clothes care device compact.

In addition, although the washing water supply device is provided in the washing device 10 in the above-described clothes care device 1, the washing water supply device may be included in the washing water collection box 50 by providing an electric cable and a water supply tube as illustrated in the first application example. Accordingly, it is possible to reduce the washing device 10 in size and weight and thus it is possible to facilitate handling thereof.

The object to be removed is not limited to clothes. As long as including a fabric, the disclosure is applicable. For example, partial contamination of curtains, bed sheets, tablecloths, etc. may also be removed.

The clothes care device is targeted for partial contamination, but may perform total contamination removal. For example, in the case of removing partial contamination of a small object such as a handkerchief, the entire contamination of the handkerchief may be removed as a result.

In addition, although the above-described embodiment exemplifies a clothes care device suitable for removing partial contamination, a function of removing wrinkles may be provided.

Particularly, the steam may be sprayed from the inside of the suction pipe 12 toward the washing port 120. The steam may be sprayed on a fabric, which is to be spread by pressing the washing surface 181 to the clothes C, and thus it is possible to remove wrinkles of the clothes C.

Based on that washing water and steam are selected and sprayed from the spray nozzle 19, partial pollution removal and wrinkle removal may be performed independently of each other. In this case, a second spray nozzle separated from the first spray nozzle 19 and provided to face the washing port 120 may be provided inside the suction pipe 12 and steam may be sprayed from the second spray nozzle.

Because the washing water supply device includes the humidification unit 71 in the case of the first application example, it is possible to use the steam generator 711(71). Therefore, it is possible to easily implement the washing port 120 including the first and second nozzle sprays.

As is apparent from the above description, a clothes care device may effectively remove partial contamination of clothes in a short time. Further, it is easy to handle the clothes care device and thus the convenience may be improved.

While the disclosure has been shown and described with reference to various embodiments thereof, it will be understood by those skilled in the art that various changes in form and detail may be made therein without departing from the spirit and scope of the disclosure as defined by the appended claims and their equivalents.

What is claimed is:

1. A clothes care device comprising:

a collection box in which an electric fan is provided;

a suction pipe comprising a washing port;

a relay pipe configured to communicate with the suction pipe;

a pressure-resistant hose with one end connected to the relay pipe and the other end connected to the collection box, the pressure-resistant hose being flexible;

a tank configured to store washing water, the tank removably fitted under the relay pipe;

a washing cover removably mounted to the washing port;

a spray nozzle provided inside the suction pipe and spaced apart from the washing cover, the spray nozzle facing the washing port; and a pump configured to supply the washing water stored in the tank to the spray nozzle, wherein the suction pipe is configured to allow a suction force to be generated in the washing port by the electric fan.

2. The clothes care device of claim 1, wherein the washing cover comprises:

a mounting frame having a rectangular shape, and a linear frame extending in an inclined direction with respect to an edge of the mounting frame.

3. The clothes care device of claim 1, wherein the spray nozzle is configured to have a spraying force for generating a vortex in the washing port together with a suction force generated by the electric fan.

4. The clothes care device of claim 1, wherein in response to the electric fan being operated, the washing cover is configured to be in close contact with clothes to be washed.

5. The clothes care device of claim 4, wherein the washing cover is further configured such that a washing surface in close contact with the clothes to be washed comprises a flat surface.

6. The clothes care device of claim 5, wherein the washing cover is further configured to maintain a constant distance between the washing surface and the spray nozzle in response to the electric fan being operated.

7. The clothes care device of claim 1, wherein the collection box comprises:

a water storage tank configured to store foreign substances suctioned through the suction pipe, and a filtration tank comprising a filter configured to filter out foreign substances passing through the water storage tank.

8. The clothes care device of claim 7, wherein the electric fan is disposed on a flow path between the filtration tank and an outlet port of the collection box.

9. The clothes care device of claim 1, wherein a distance from the spray nozzle to the washing cover is set to a distance at which a vortex is generated in the washing port in response to the electric fan being operated.

10. The clothes care device of claim 1, wherein the washing cover comprises at least one of a first washing cover configured to remove partial contamination or a second washing cover configured to remove foreign substances.

11. The clothes care device of claim 10, wherein a washing surface of the first washing cover includes a plurality of linear frames crossing each other in a lattice shape, the plurality of linear frames inclined with respect to a washing direction, and wherein an area of each opening portion of the washing surface is greater than or equal to 4 $mm^2$, but less than or equal to 240 $mm^2$.

12. The clothes care device of claim 10, wherein a washing surface of the second washing cover includes a lattice shape composed of linear frames perpendicular to each other, and wherein an area of each opening portion is set to be greater than 240 $mm^2$.

* * * * *